US005104287A

United States Patent [19]

Ciokajlo

[11] Patent Number: 5,104,287

[45] Date of Patent: Apr. 14, 1992

[54] BLADE TIP CLEARANCE CONTROL APPARATUS FOR A GAS TURBINE ENGINE

[75] Inventor: John J. Ciokajlo, Cincinnati, Ohio

[73] Assignee: General Electric Company, Cincinnati, Ohio

[21] Appl. No.: 405,369

[22] Filed: Sep. 8, 1989

[51] Int. Cl.[5] ..... F01D 11/08

[52] U.S. Cl. ..... 415/173.2; 415/126

[58] Field of Search ..... 415/173.2, 173.3, 173.6, 415/174.1, 174.2, 126, 127

[56] References Cited

U.S. PATENT DOCUMENTS

| | | | |
|---|---|---|---|
| 3,039,737 | 6/1962 | Kothoff | 415/17 |
| 3,062,497 | 11/1962 | Howes et al. | 415/126 |
| 3,085,398 | 4/1963 | Ingleson | 60/39.32 |
| 3,520,635 | 7/1970 | Killmann et al. | 415/138 |
| 3,623,736 | 11/1971 | Petrie et al. | 277/27 |
| 3,730,640 | 5/1973 | Rice et al. | 415/117 |
| 3,966,354 | 12/1974 | Patterson | 415/116 |
| 3,966,356 | 6/1976 | Irwin | 415/173.3 |
| 4,005,946 | 2/1977 | Brown et al. | 415/136 |
| 4,050,843 | 9/1977 | Needham et al. | 415/116 |
| 4,230,436 | 10/1980 | Davison | 415/1 |
| 4,264,274 | 4/1981 | Benedict | 415/199.5 |
| 4,330,234 | 5/1982 | Colley | 415/173.2 |
| 4,332,523 | 6/1982 | Smith | 415/126 |
| 4,343,592 | 8/1982 | May | 415/173.2 |
| 4,384,819 | 5/1983 | Baker | 415/14 |
| 4,419,044 | 12/1983 | Barry et al. | 415/117 |
| 4,632,635 | 12/1986 | Thoman et al. | 415/14 |
| 4,657,479 | 4/1987 | Brown et al. | 415/138 |
| 4,683,716 | 8/1987 | Wright et al. | 60/226.1 |
| 4,714,404 | 12/1987 | Lardellier | 415/127 |
| 4,773,817 | 9/1988 | Stanglini | 415/48 |

FOREIGN PATENT DOCUMENTS

| | | | |
|---|---|---|---|
| 152907 | 7/1986 | Japan | 415/173.2 |
| 142808 | 6/1987 | Japan | 415/173.2 |
| 869908 | 6/1961 | United Kingdom | 415/173.2 |
| 881880 | 11/1961 | United Kingdom | 415/173.3 |
| 2038956 | 7/1980 | United Kingdom . | |
| 2068470 | 8/1981 | United Kingdom . | |
| 2099515 | 12/1982 | United Kingdom . | |
| 2199664 | 7/1988 | United Kingdom . | |

OTHER PUBLICATIONS

Technical Report AFAPL-TR-79-2087, entitled "Thermal Response Turbine Shroud Study" by E. J. Kawecki of Pratt & Whitney, Jul. 1979.

*Primary Examiner*—John T. Kwon

*Attorney, Agent, or Firm*—Jerome C. Squillaro

[57] ABSTRACT

A mechanical clearance control apparatus is operable for controlling the clearance between the rotor blade tips and the casing shroud of a gas turbine engine. The apparatus includes a shroud segment which defines a circumferential portion of the casing shroud and is disposed in an opening defined by a mounting section of the stationary casing, a channel defined between radially spaced portions of the shroud segment and the stationary casing mounting section, and a wave spring disposed in the channel and preloaded against the shroud segment and mounting section for biasing the shroud segment to move radially inward toward the rotor. Flanges on opposite sides of the shroud segment and on the stationary casing mounting section at opposite sides of the opening cooperate to define inner and outer limits of radial movement of the shroud segment as the shroud segment is moved toward and away from the rotor. A mechanism is rotatably mounted to the stationary casing mounting section, threadably coupled to the shroud segment and pivotaly linked to a unison ring for moving the shroud segment toward and away from the rotor to set the clearance between the shroud segment and the rotor blade tips upon rotational movement of the unison ring.

9 Claims, 9 Drawing Sheets

BLADE TIP CLEARANCE CONTROL APPARATUS FOR A GAS TURBINE ENGINE

CROSS-REFERENCE TO RELATED APPLICATION

Reference is hereby made to the following copending U.S. patent application dealing with related subject matter and assigned to the assignee of the present invention: "Radial Adjustment Mechanism For Blade Tip Clearance Control Apparatus" by John T. Ciokajlo, assigned U.S. Ser. No. 405,374 and filed Sept. 8, 1989.

BACKGROUND OF THE INVENTION

1. Field of the Invention

The present invention relates generally to gas turbine engines and, more particularly, to an apparatus for controlling clearance between adjacent rotating and non-rotating components of a gas turbine engine.

2. Description of the Prior Art

The efficiency of a gas turbine engine is dependent upon many factors, one of which is the radial clearance between adjacent rotating and non-rotating components, such as, the rotor blade tips and the casing shroud surrounding the outer tips of the rotor blades. If the clearance is too great, an unacceptable degree of gas leakage will occur with a resultant loss in efficiency. If the clearance is too little, there is a risk that under certain conditions contact will occur between the components.

The potential for contact occurring is particularly acute when the engine rotational speed is changing, either increasing or decreasing, since temperature differentials across the engine frequently result in the rotating and non-rotating components radially expanding and contracting at different rates. For instance, upon engine accelerations, thermal growth of the rotor typically lags behind that of the casing. During steady-state operation, the growth of the casing ordinarily matches more closely that of the rotor. Upon engine decelerations, the casing contracts more rapidly than the rotor.

Control mechanisms, usually mechanically or thermally actuated, have been proposed in the prior art to maintain blade tip clearance substantially constant. However, none are believed to represent the optimum design for controlling clearance. Consequently, a need still remains for an improved mechanism for clearance control that will permit maintenance of minimum rotor blade tip-shroud clearance throughout the operating range of the engine and thereby improve engine performance and reduce fuel consumption.

SUMMARY OF THE INVENTION

The present invention provides a mechanical blade tip clearance control apparatus which satisfies the aforementioned needs and achieves the foregoing objectives. A radial adjustment mechanism is also disclosed herein. The radial adjustment mechanism comprises the invention of the copending application cross-referenced above; however, it is described herein for facilitating a complete and thorough understanding of the clearance control apparatus of the present invention and for purposes of best mode requirements.

The clearance control apparatus of the present invention is provided in a gas turbine engine including a rotatable rotor having a row of blades with tips and a stationary casing, with a shroud, disposed in concentric relation with the rotor. The clearance control apparatus, operable for controlling the clearance between the rotor blade tips and the casing shroud, comprises: (a) a shroud segment defining a circumferential portion of the casing shroud and being separate from the casing and disposed in an opening defined in the stationary casing; (b) a channel defined between radially spaced portions of the stationary casing and the shroud segment; (c) means disposed in the channel and being preloaded against the spaced portions of the stationary casing and shroud segment for biasing the shroud segment to move radially inwardly toward the rotor; and (d) a mechanism coupled to the shroud segment and the stationary casing and being operable for moving the shroud segment toward and away from the rotor to reach a selected position relative to the rotor at which a desired clearance is established between the shroud segment and rotor blade tips. The mechanism further is operable for holding the shroud segment at the selected position to maintain the desired clearance between the shroud segment and rotor blade tips.

The clearance control apparatus of the present invention also comprises means for defining inner and outer limits of movement of the shroud segment relative to the stationary casing toward and away from the rotor. The limits defining means includes a pair of outer and inner radially spaced stop members disposed along each of the opposite edges of the shroud segment and attached on one of the stationary casing and the shroud segment, and an intermediate member disposed along each of the opposite edges of the shroud segment and attached on the other of the stationary casing and the shroud segment. The intermediate members project therefrom between the pairs of outer and inner stop members for engaging the respective stop members to define inner and outer limits of radial movement of the shroud segment as the shroud segment is moved toward and away from the rotor.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
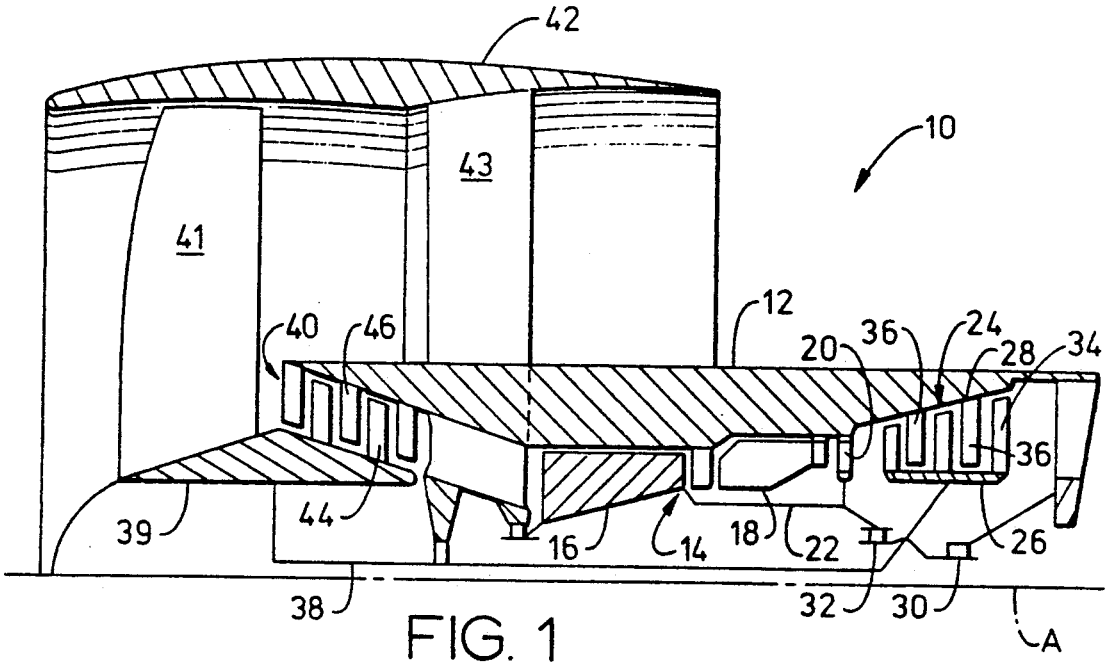
FIG. 1 is a schematic view of a gas turbine engine.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

In General

Referring now to the drawings, and particularly to FIG. 1, there is illustrated a gas turbine engine, generally designated 10, to which the present invention can be applied. The engine 10 has a longitudinal center line or axis A and an annular casing 12 disposed coaxially and concentrically about the axis A. The engine 10 includes a core gas generator engine 14 which is composed of a compressor 16, a combustor 18, and a high pressure turbine 20, either single or multiple stage, all arranged coaxially about the longitudinal axis or center line A of the engine 10 in a serial, axial flow relationship. An annular drive shaft 22 fixedly interconnects the compressor 16 and high pressure turbine 20.

The core engine 14 is effective for generating combustion gases. Pressurized air from the compressor 16 is mixed with fuel in the combustor 18 and ignited, thereby generating combustion gases. Some work is extracted from these gases by the high pressure turbine 20 which drives the compressor 16. The remainder of the combustion gases are discharged from the core engine 14 into a low pressure power turbine 24.

The low pressure turbine 24 includes an annular drum rotor 26 and a stator 28. The rotor 26 is rotatably mounted by suitable bearings 30 and includes a plurality of turbine blade rows 34 extending radially outwardly therefrom and axially spaced. The stator 28 is disposed radially outwardly of the rotor 26 and has a plurality of stator vane rows 36 fixedly attached to and extending radially inwardly from the stationary casing 12. The stator vane rows 36 are axially spaced so as to alternate with the turbine blade rows 34. The rotor 26 is fixedly attached to drive shaft 38 and interconnected to drive shaft 22 via differential bearings 32. The drive shaft 38, in turn, rotatably drives a forward booster rotor 39 which forms part of a booster compressor 40 and which also supports forward fan blade rows 41 that are housed within a nacelle 42 supported about the stationary casing 12 by a plurality of struts 43, only one of which is shown. The booster compressor 40 is comprised of a plurality of booster blade rows 44 fixedly attached to and extending radially outwardly from the booster rotor 39 for rotation therewith and a plurality of booster stator vane rows 46 fixedly attached to and extending radially inwardly from the stationary casing 12. Both the booster blade rows 44 and the stator vane rows 46 are axially spaced and so arranged to alternate with one another.

Clearance Control Apparatus of the Prior Art

Figure 2:
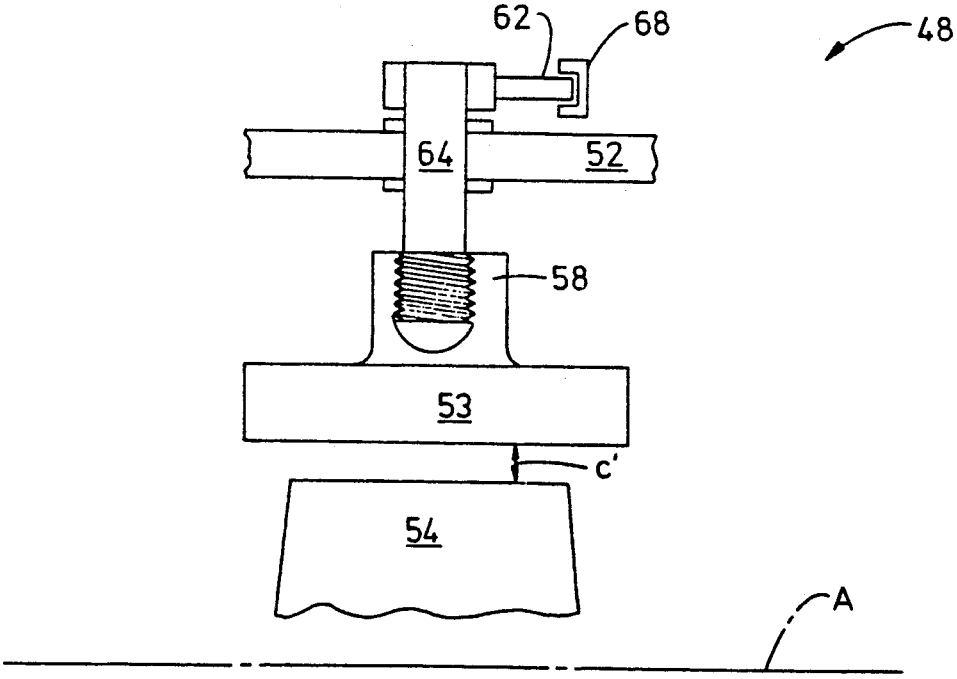
FIG. 2 (PRIOR ART)
FIG. 2 is a longitudinal axial sectional view of one prior art mechanical apparatus for controlling rotor blade tip and stator casing shroud clearance.
Figure 3:
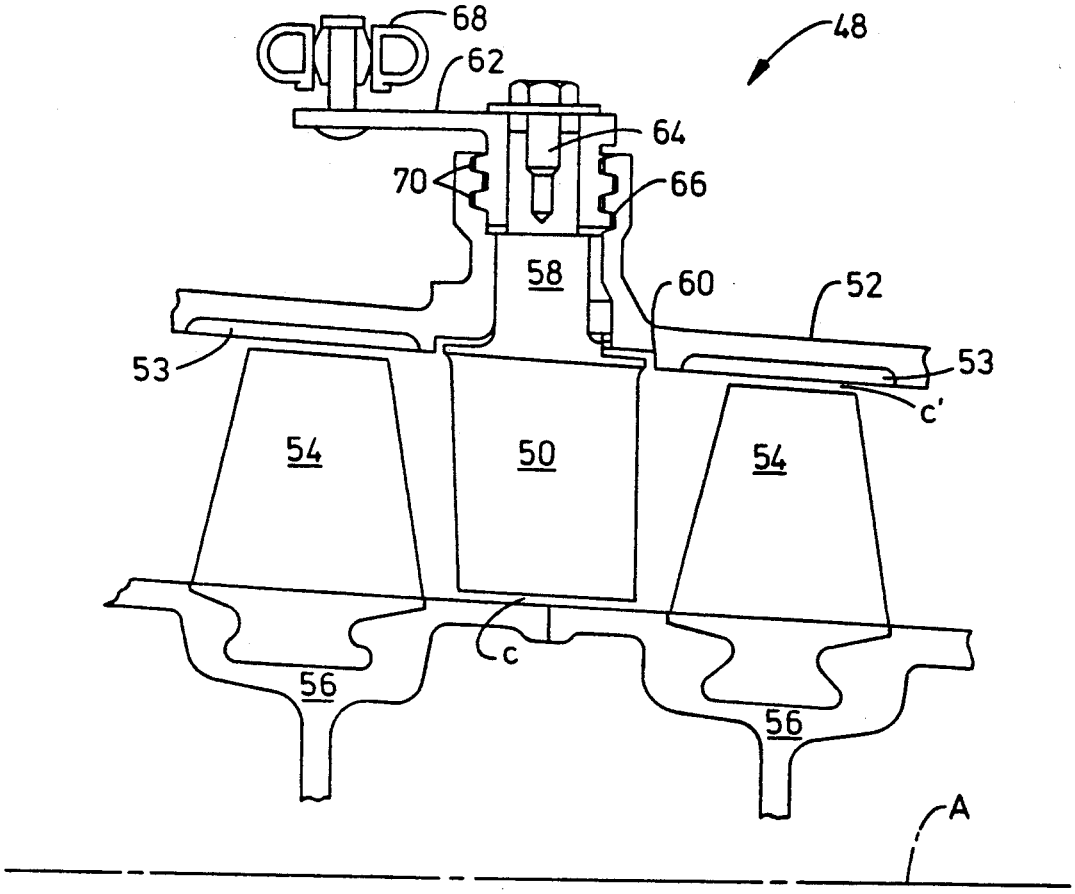
FIG. 3 (PRIOR ART)
FIG. 3 is a longitudinal axial sectional view of another prior art mechanical apparatus for controlling rotor and stator vane tip clearance.
Figure 4:
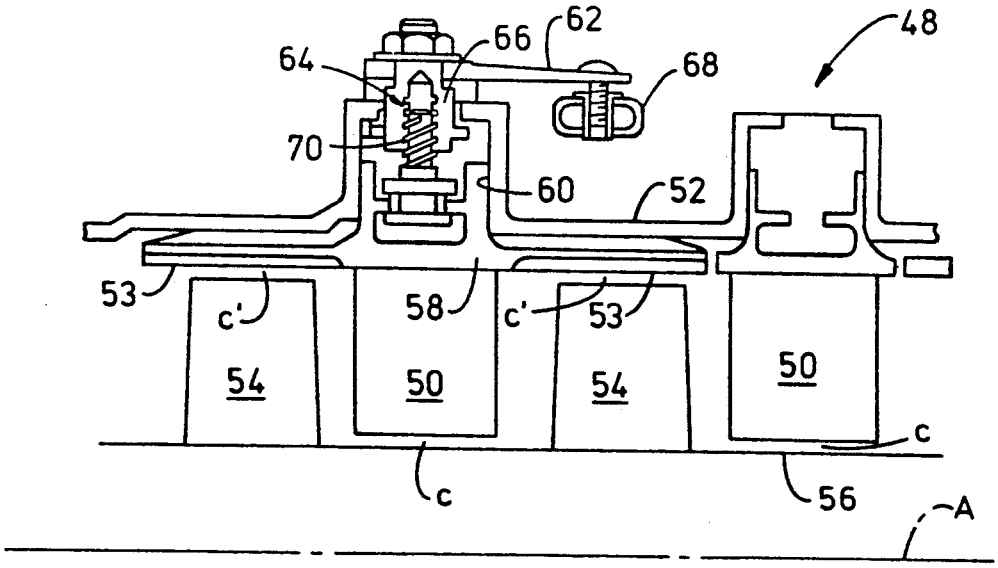
FIG. 4 (PRIOR ART)
FIG. 4 is a longitudinal axial sectional view of yet another prior art mechanical apparatus for controlling rotor blade tip and stator casing shroud clearance and rotor and stator vane tip clearance.
Figure 5:
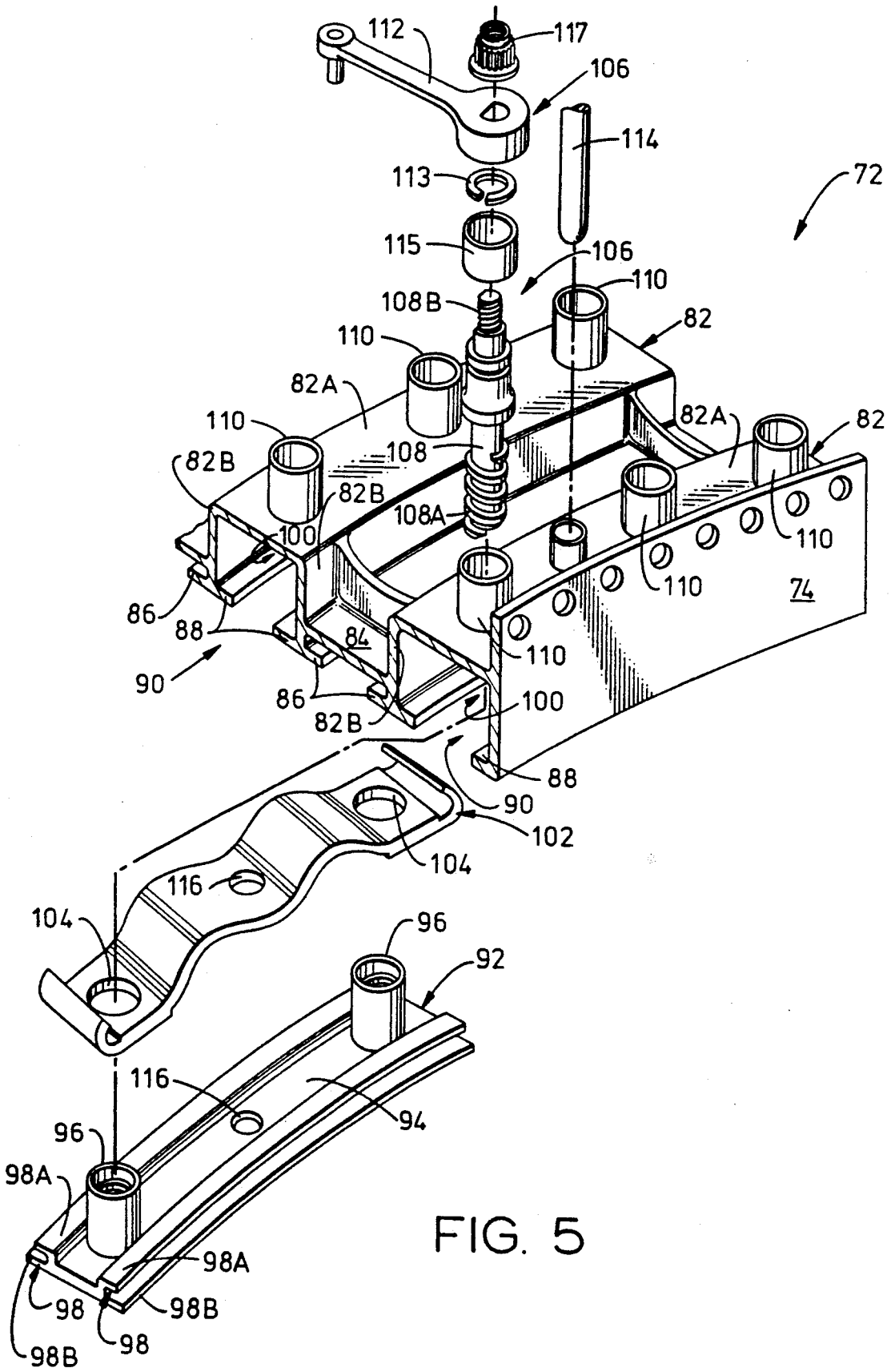
FIG. 5 is an exploded perspective view of one embodiment of a mechanical blade tip clearance control apparatus in accordance with the present invention.
Figure 6:
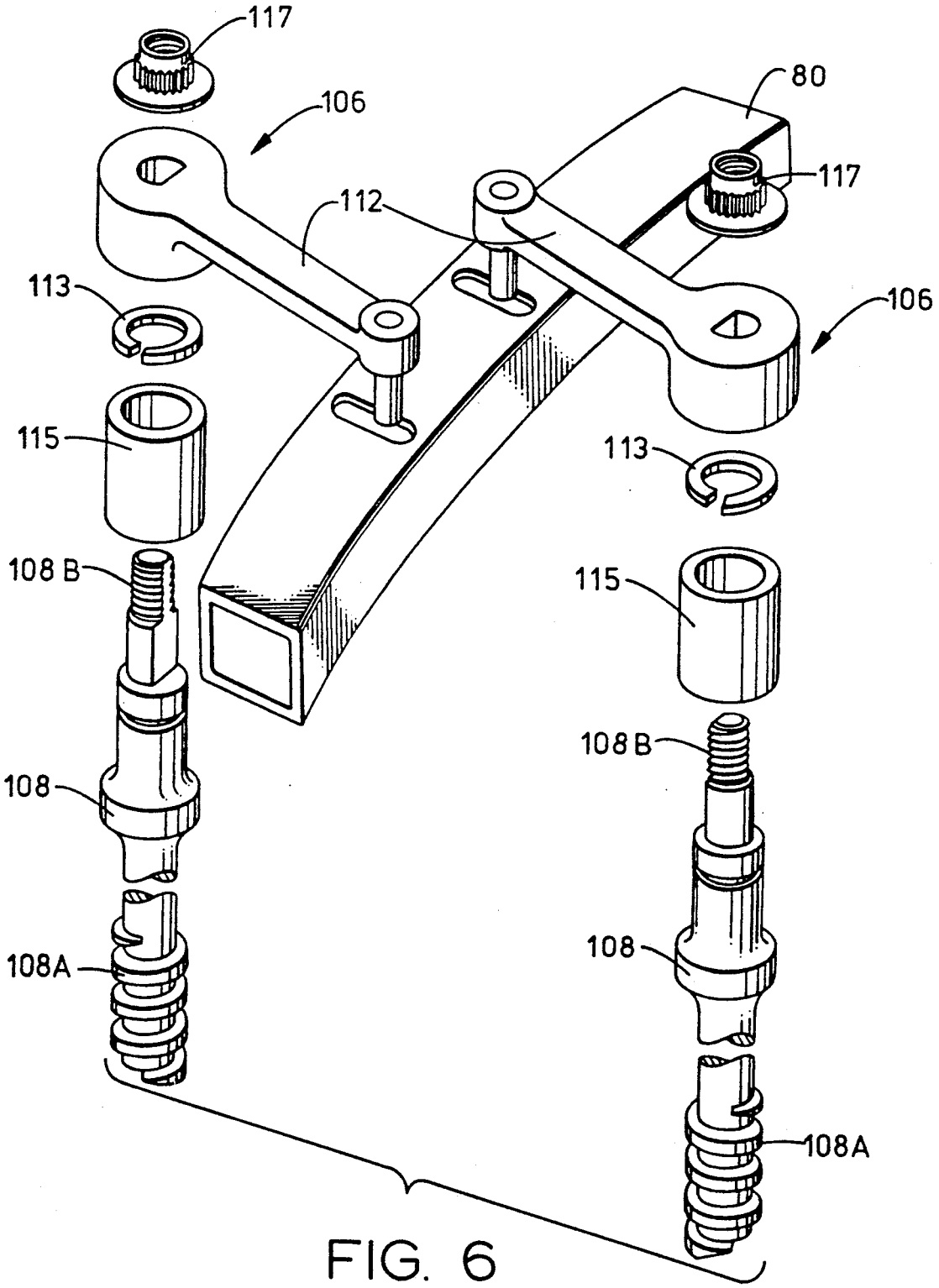
FIG. 6 is an exploded perspective view of components for actuating the clearance control apparatus of FIG. 5.
Figure 7:
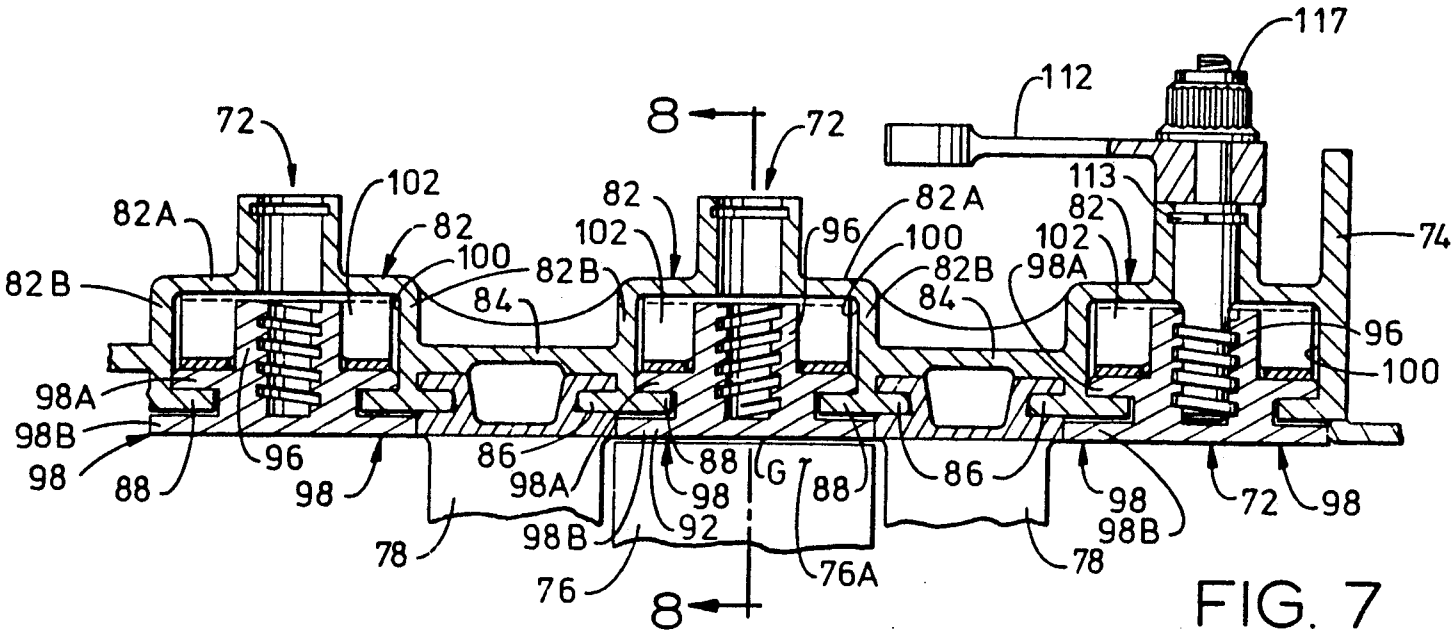
FIG. 7 is a longitudinal axial sectional view of the clearance control apparatus of FIG. 5 in assembled form.
Figure 8:
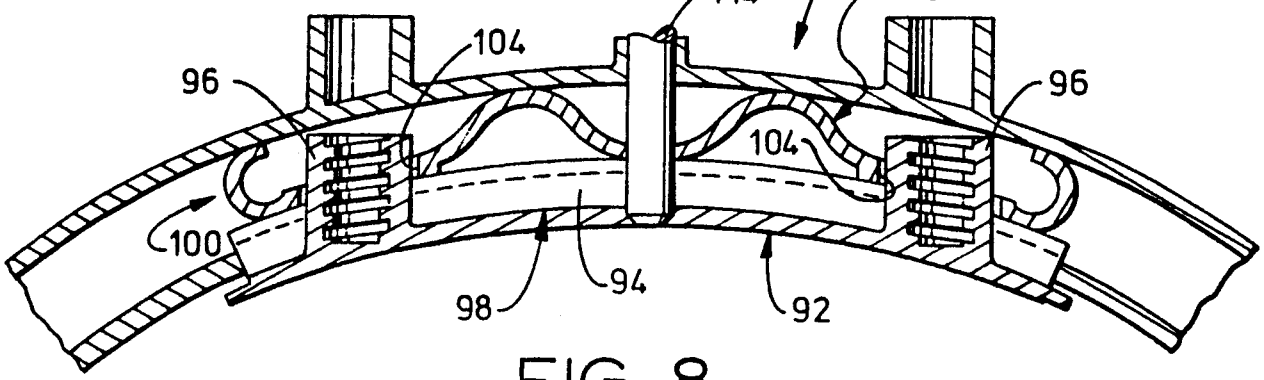
FIG. 8 is a transverse sectional view of the clearance control apparatus of FIG. 5 taken along line 8—8 of FIG. 7.

Referring now to FIGS. 2, 3 and 4, there is illustrated three variations of a prior art clearance control apparatus, generally designated 48 (disclosed on pages 8 and 15 of a publication entitled "Thermal Response Turbine Shroud Study" by E. J. Kawecki, dated July 1979, Technical Report AFAPL-TR-79-2087). The clearance control apparatus 48 is operable for changing the tip clearance gap C between the stator vanes 50, coupled on a stationary casing 52, and a rotatable rotor 56; and/or, the tip clearance gap C' between the rotatable rotor blades 54 and the casing shroud 53 of a gas turbine engine, such as the engine 10 just described.

In the FIG. 2 embodiment, the shroud segment 53 is separate from the casing 52 and is mounted on the end of screw 64 for radial movement relative to the casing 52 toward and away from the tip of the rotor blade 54 for adjustment of the clearance gap C' therebetween. In the FIGS. 3 and 4 embodiments, the stator vanes 50 are mounted on shanks 58 which, in turn, are disposed in openings 60 in the casing 52 for radial movement toward and away from the rotor 56. Each shank is coupled to a lever arm 62 by a screw 64 threaded into a fitting 66 attached to the casing 52. Also, a unison ring 68 upon circumferential movement rotates the screw 64 via the lever arm 62 in order to adjust the clearance gap. To reduce the effects of thermal expansion on the clearance control apparatus 48, each screw 64 has threads 70 of a square cross section. In each of these embodiments, the shroud segment 53 is attached to the stationary casing 52 with the shroud segment 53 being fixedly attached in the FIG. 3 embodiment and movably attached in the FIG. 4 embodiment.

It should be noted that in the FIG. 3 embodiment, the clearance control apparatus 48 operates to adjust the clearance gap C between the tip of the stator vane 50 and the rotor 56, but does not adjust the clearance gap C' between the tip of the rotor blade 54 and the shroud segment 53. However, in the FIG. 4 embodiment, operation of the clearance control apparatus 48 not only adjusts the clearance gap C between the tip of the stator vane 50 and the rotor 56, but also, simultaneously therewith, adjusts the clearance gap C' between the tip of the rotor blade 54 and the shroud segment 53.

Clearance Control Apparatus of Present Invention

Turning now to FIGS. 5–8, there is illustrated a first embodiment of a mechanical clearance control apparatus, generally designated 72, in accordance with the present invention. This apparatus 72 can advantageously be used with all compressor and turbine rotors of a gas turbine engine, such as the engine 10 illustrated in FIG. 1, where the rotors have smooth shrouded outer flowpaths and where rotor blade tip to shroud operating minimum clearances are required over the operating range of the engine. Also, the clearance control apparatus 72 is applicable to either aircraft or land based gas turbine engines.

The clearance control apparatus 72 is operable for controlling the clearance between a stationary casing 74 and a rotor (not shown) being represented by the outer tips 76A of rotor blades 76 (shown in FIG. 7) which extend radially outwardly in alternating fashion between stator vanes 78 which, in turn, are stationarily attached to and extending radially inwardly from the casing 74. More particularly, a plurality of the clearance control apparatuses 72 are ganged to a circumferentially extending unison ring 80 by components shown in FIG. 6 to operate moving parts of the apparatuses 72 together to control the clearance the entire 360 degrees around the rotor blade tips 76A and the stationary casing 74.

Each clearance control apparatus 72 is associated with a separate mounting section 82 formed in the stationary casing 74. The mounting section 82 has an inverted-U cross-sectional shape defined by an arcuate top wall 82A and a pair of integrally-connected axially-spaced side walls 82B. The side walls 82B of adjacent mounting sections 82 are rigidly interconnected by web sections 84 of the stationary casing 74 and have a pair of oppositely and axially extending exterior and interior hanger flanges 86, 88. The exterior hanger flanges 86 of adjacent mounting sections 82 together with the web sections 84 define hook structures for attachment of the stator vanes 78 to the stationary casing 74. The interior hanger flanges 88 of each mounting section 82 defines an elongated opening 90 in the stationary casing 74.

Each clearance control apparatus 72 includes a shroud segment 92 separate from the stationary casing 74 and disposed in the opening 90 defined in the respective mounting section 82 of the stationary casing 74. By way of example, the shroud segment 92, shroud segment mounting section 82, and shroud opening 90 extend for 30° or one-twelfth of the circumference of the stationary casing 74. In this example, therefore, there would be twelve clearance control apparatuses 72 (and thus twelve shroud segments 92) ganged to the unison ring 80.

Each shroud segment 92 includes an elongated arcuate body 94, a pair of internally-threaded cylindrical bosses or connectors 96 spaced circumferentially from one another and fixedly attached on the outer surface of the arcuate body 94, and a pair of substantially C-shaped hanger flange 98 formed along respective opposite longitudinal sides of the body 94. The hanger flanges 98 of each shroud segment 92 have respective pairs of radially spaced outer and inner flange portions 98A, 98B which receive therebetween the interior hanger flanges 88 of the respective mounting section 82 for mounting the shroud segment 92 to the mounting section 82.

The hanger flange portions 98A, 98B of each pair thereof at the sides of the shroud segment 92 are radially displaced a greater distance apart than the thickness of the interior flanges 88 such that the flange portions define a pair of outer and inner radially spaced stop members disposed along each of the opposite longitudinal sides of the shroud segment body 94. The interior flanges 88 on the stationary mounting section 82 project between the outer and inner shroud segment flange portions 98A, 98B (or stop members) and are engageable with therewith at inner an outer limits of radial movement of the shroud segment 92 toward and away from the rotor blade tip 76A. Thus, the shroud segment hanger flange portions 98A, 98B together with the mounting section interior flanges 88 provide an arrangement which defines the inner and outer limits of movement of the shroud segment 92 relative to the stationary opening 90 toward and away from the rotor blade tip 76A.

Each clearance control apparatus 72 also incorporates a channel 100 defined between radially spaced portions of the stationary casing 74 and the shroud segment 92, and biasing means 102 disposed in the channel 100 and being preloaded against the spaced portions of the stationary casing 74 and shroud segment 92 for biasing the shroud segment to move radially inwardly toward the rotor blade tip 76A. Such spaced portions defining the channel 100 therebetween are the top wall 82A of the stationary mounting section 82 and the outer flange portions 98A of the hanger flanges 98 on the sides of the shroud segment 92.

The biasing means of the clearance control apparatus 72 is preferably a wave spring 102 disposed in the channel 100. The wave spring 102 is in the form of an elongated strip having an undulating configuration along a longitudinal cross section through the strip. The spring 102 has a pair of spaced openings 104 defined therethrough for mounting the spring on the shroud segment 92 with the connectors 96 of the segment extending through the spring openings 104 so as to prevent movement of the spring 102 longitudinally within the channel 100 relative to the shroud segment 92.

Finally, the clearance control apparatus 72 includes a mechanism 106 (best seen in FIG. 6) coupled to the shroud segment 92 and the stationary mounting section 82 and linked to the unison ring 80. The mechanism 106 includes one or more shaft-like threaded drive members 108 rotatably supported through cylindrical bosses 110 formed on the top wall 82A of the mounting section 82, and one or more lever arms 112. Snap rings 113 in the bosses 110 and connection to the drive members 108 prevent the latter from moving axially relative to the bosses. The lower threaded ends 108A of the drive members 108 are threadably coupled in the connectors 96 on the shroud segment body 94. The lever arms 112 are connected at one end to the upper ends 108B of the drive members 108 for pivoting about the rotation axis of the drive members 108 upon rotation of the latter. Spacer sleeves 115 are disposed about the drive members 108 and nuts 117 are attached on their upper ends which extend above the lever arm ends. The lever arms 112 are pivotally connected at their opposite ends to the unison ring 80. Thus, upon rotation of the unison ring 80 circumferentially about the stationary casing 74, the lever arms 112 pivot and the drive members 108 rotate in one or the opposite direction causing radial movement of the shroud segment 92 toward or away from the rotor blade tip 76A.

In such manner, the mechanism 106 is operable for radially moving the shroud segment 92 toward and away from the rotor blade tip 76A to reach a selected position relative to the rotor (not shown) at which a desired clearance (gap G in FIG. 7) is established between the shroud segment 92 and the rotor blade tip 76A. Further, the mechanism 106 is operable for holding the shroud segment 92 at the selected position to maintain the desired clearance between the shroud segment and the rotor blade tip upon termination of rotation of the unison ring 80. The wave spring 102 maintained under a state of compression within the channel 100 continues to impose an inward biasing force on the shroud segment 92 regardless of the radial position of the latter in order to ensure uniform movement of the shroud segment 92 and to deter it from vibrating and rattling within the mounting section 82.

A rotor clearance sensor 114 (FIG. 8) can be installed through aligned central holes 116 in the wave spring 102 and shroud segment 92 for sensing the actual rotor blade tip shroud clearance and sending a signal to a control device which, in turn, activates an actuator to rotate the unison ring 80 for changing the clearance in the manner described earlier. Since the sensor 114 and the components associated therewith form no part of the present invention, a detailed discussion of them is not necessary.

Figure 9:
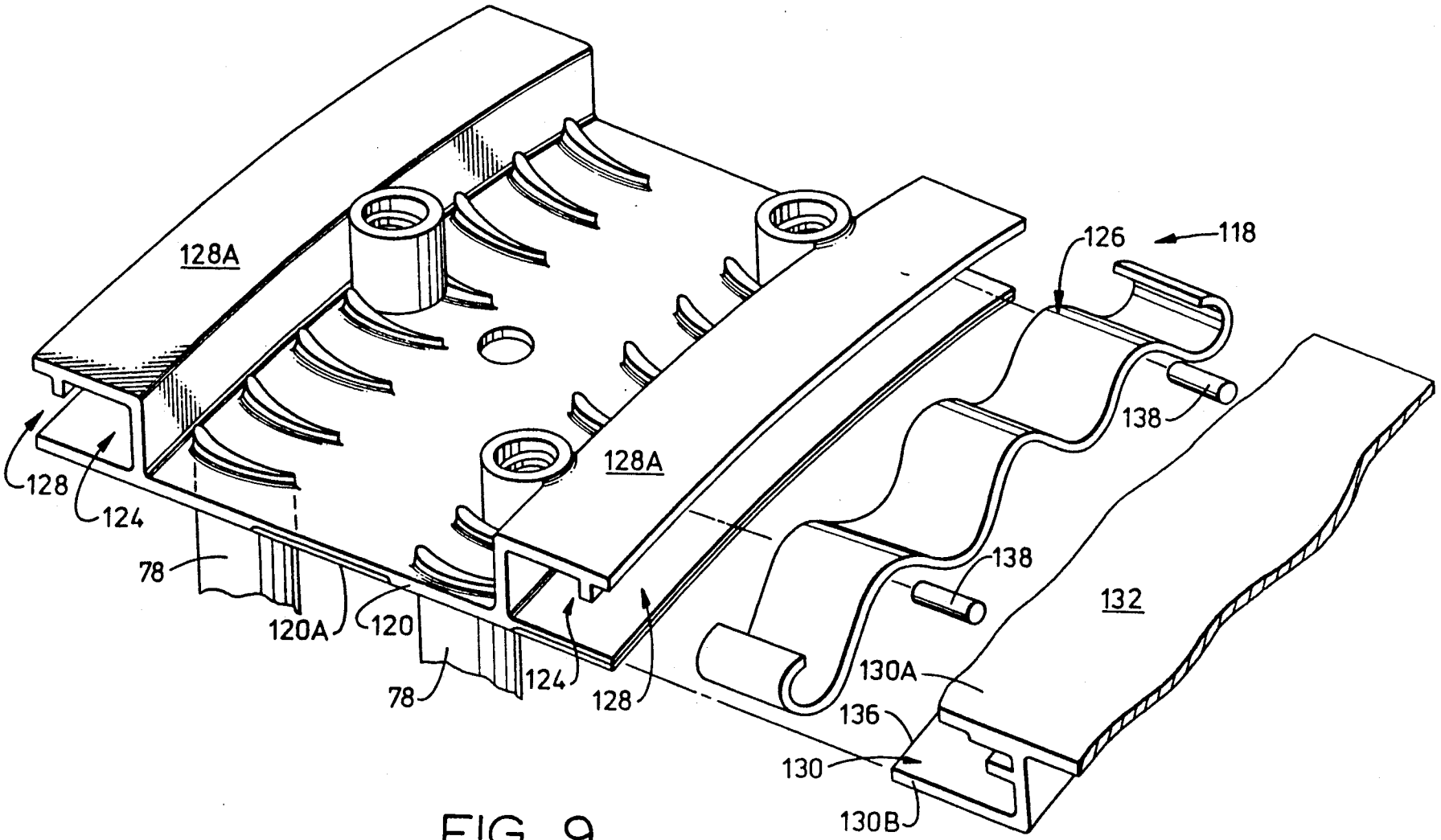
FIG. 9 is an exploded perspective view of another embodiment of a mechanical blade tip clearance control apparatus in accordance with the present invention.
Figure 10:
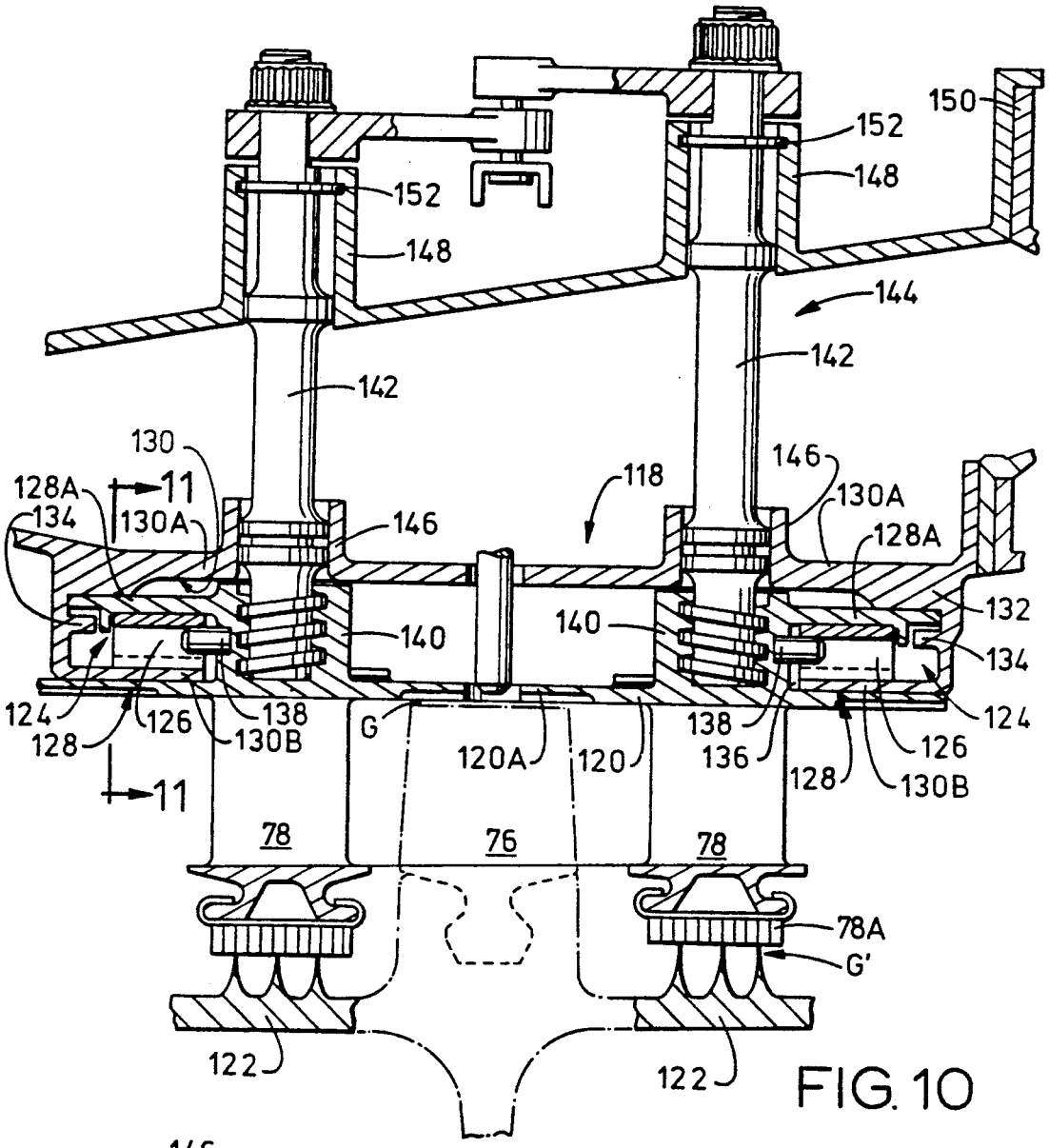
FIG. 10 is a longitudinal axial sectional view of the clearance control apparatus of FIG. 9 in assembled form.
Figure 11:
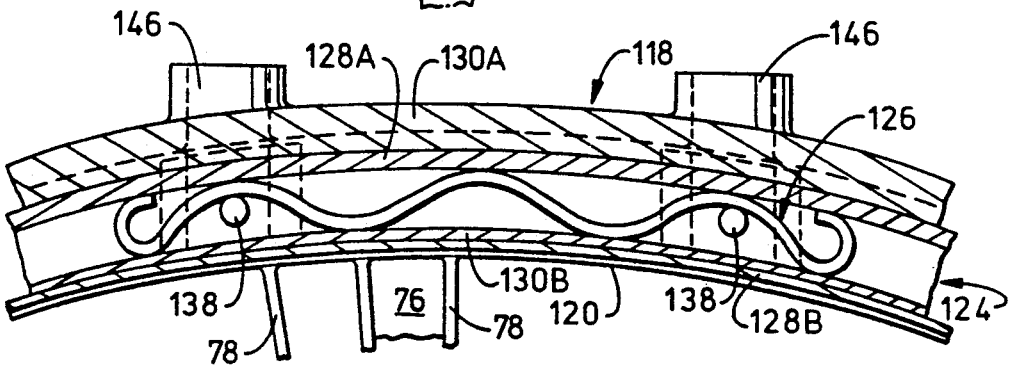
FIG. 11 is a transverse sectional view of the clearance control apparatus of FIG. 9 taken along line 11—11 of FIG. 10.

Referring now to FIGS. 9–11, there is shown a second embodiment of the mechanical clearance control apparatus of the cross-referenced invention, generally designated 118. The construction and operation of the second embodiment of the clearance control apparatus 118 is similar to the first embodiment of the apparatus 72 of FIGS. 5–8. Thus, only the differences in the construction of the second apparatus 118 compared to the first apparatus 72 will be discussed.

One difference between the constructions is that a shroud segment support 120 of the second apparatus 118 fixedly supports shroud segments 120A and stator vanes 78 of one and preferably two rows of the vanes. Thus, the shroud segment 120A of the shroud segment support 120 is directly over the rotor blades 76 between the two rows of stator vanes. The clearance being adjusted and set is that between the blade tip 76A and the shroud segment 120A (gap G in FIGS. 7 and 10) and also the clearance between the inner tip 78A of the stator vanes 78 and a labyrinth seal structure 122 attached to the rotor (gap G' in FIG. 10).

Another difference between the constructions is that the channels 124 housing the wave springs 126 are defined along the opposite sides of the shroud segment 120 by interfitting C-shaped hanger flanges 128, 130 formed respectively on the shroud segment 120 and stationary shroud mounting section 132. More particularly, the channels 124 are defined between outer flange portions 128A on the shroud segment and inner flange portions 130B on the mounting section 132. The wave springs 126 are disposed in a state of compression within the channels 124, preloaded against the outer and inner flange portions 128A, 130B of the shroud segment 120 and mounting section 132 and thereby biasing the shroud segment 120 for inward radial movement.

A further difference between the constructions is the provision of a interior ledge 134 on the mounting section 132 spaced radially inwardly from the outer flange portion 130A. The ledge 134 and outer flange portion 130A on the mounting section 132 together form the pair of stop members along each of the opposite sides of the opening 136 in the stationary casing 74. The edge of the outer flange portion 128A of the shroud segment 120 extends within the gap between the ledge 134 and outer flange portion 130A on the mounting section 132 and will engage one or the other upon the shroud segment 120 moving and reaching the inner or outer limits of its radial movement.

Still another difference in the constructions is that pins 138 are mounted to the connectors 140 on the shroud segments 120 and project therefrom into the channels 124 housing the wave springs 126. The pins 138 engage the springs 126 so as to prevent their movement longitudinally within the channels relative to the shroud segment 120.

Finally, the drive members 142 of the mechanism 144 of the second apparatus 118 are rotatably mounted through bosses 146, 148 formed respectively in the inner stationary casing 74 and an outer casing 150. The threads on the drive members 108, 142 of both constructions are square in cross section. As before, snap rings 152 permit rotation of the drive members 142 but prevent axial movement thereof.

Radial Adjustment Mechanism of Cross-Referenced Invention

Figure 12:
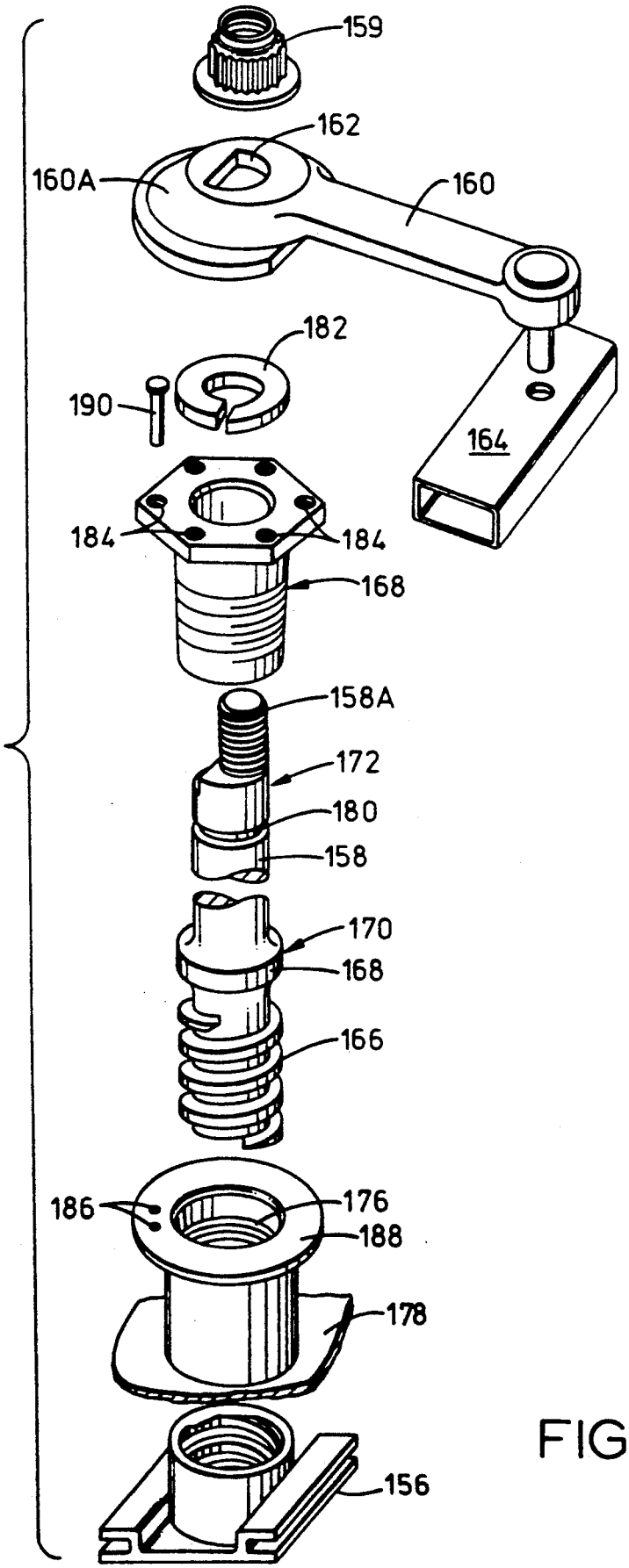
FIG. 12 is an exploded perspective view of a radial adjustment mechanism in accordance with the invention of the copending cross-referenced application which can be employed with both embodiments of the clearance control apparatus of FIGS. 5–8 and 9–11, respectively.
Figure 13:
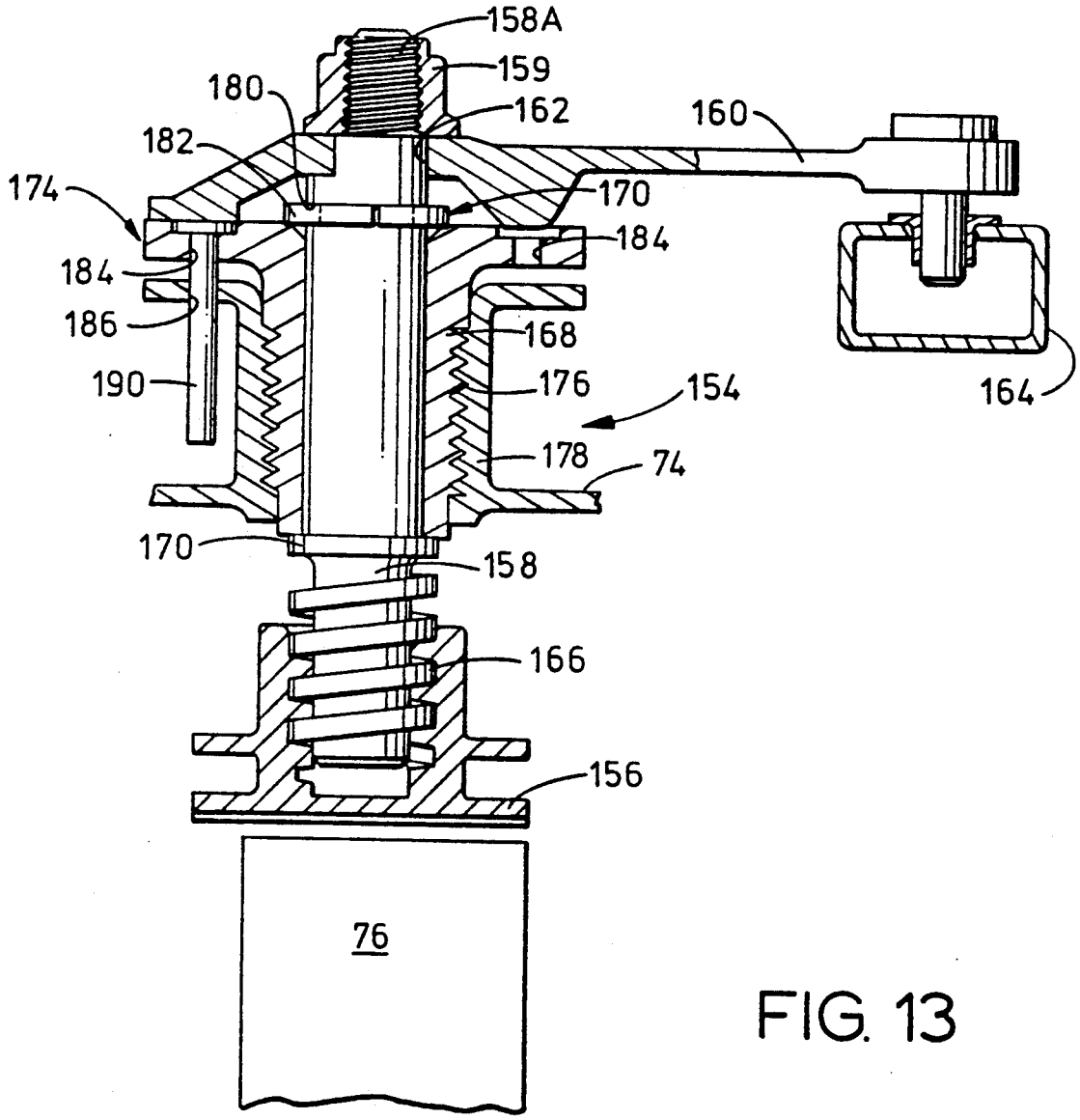
FIG. 13 is a longitudinal axial sectional view of the radial adjustment mechanism of FIG. 12 in assembled form.

Turning now to FIGS. 12–13, there is illustrated a radial adjustment mechanism, generally designated 154 and comprising the invention of the cross-referenced application. The adjustment mechanism 154 can be employed with both embodiments of the clearance control apparatus 72, 118 described above. Basically, the adjustment mechanism 154 can be applied to all rotor blade tip to shroud clearance control apparatus to initially set the rotor blade tip to shroud clearances at the time of assembly of the engine. Its use minimizes, if not eliminates, costly manufacturing procedures such as exact and repetitive thread starting locations and shroud machining.

From the earlier explanation of the construction and operation of the clearance control apparatus, it will be recalled that the shroud segment 156 shown in FIGS. 12 and 13 is moved radially by rotating a drive member in the form of an adjustment screw 158. Preferably, each adjustment screw 158 (only one shown) is connected to the lever arm 160 in a manner which ensures that there will be no relative rotation between the lever arm 160 and the screw 158. One method to accomplish this is to provide a D-shaped hole 162 through the end 160A of the lever arm 160 connected to the screw 158 and to provide an end 158A on the screw 158 having a complementary D-shape in cross section. A nut 159 is used to retain the lever arm 160 on the end 158A of the screw 158.

Use of the D-shaped coupling between the lever arm 160 and screw 158 means that all of the screws 158 of the clearance control apparatuses ganged to the unison ring 164 by the lever arms 160 must be positioned in the same rotational orientation. However, if square cross-section threads 166 on the screws 158 are not initially machined to start at the same circumferential location, then each shroud segment 156 will have a different radial position requiring shroud machining for exact rotor-shroud concentricities. It is costly to attempt to manufacture the screws 158 as exact duplicates of one another.

The radial adjustment mechanism 154 of the invention of the cross-referenced application avoids the necessity for the threads 166 on the screws 158 to have the same circumferential starting positions. The adjustment mechanism 154 permits presetting of a preselected clearance between the shroud segment 156 and a rotor blade tip without the need to rotate the screw 158 to do so.

The radial adjustment mechanism 154 includes an externally threaded hollow adjustment sleeve or bushing 168, a pair of inner and outer screw positioning elements 170, 172 on the screw 158, and locking means 174. The hollow bushing 168 of the mechanism 154 is disposed over the screw 158 and rotatably and threadably coupled to an internally threaded bore 176 in the mounting section 178 of the stationary casing 74. Thus, rotation of bushing 168 relative to the stationary mounting section bore 176 also produces axial movement of the bushing 168 relative thereto.

The inner and outer screw positioning elements 170, 172 of the radial adjustment mechanism 154 are defined thereon at locations spaced apart and disposed between the outer end 158A and threads 166 of the screw 158. The inner positioning element 170 is preferably an annular shoulder formed on the screw 158. The outer positioning element 172 is preferably composed of an annular recess 180 formed in the screw 158 and an annular member, such as a snap ring 182, releasably fitted in the annular 180 recess and projecting outwardly therefrom so as to overlie a portion of the screw 158. As seen in FIG. 13, the shoulder 170 and snap ring 182 engage the opposite ends of the bushing 168 so as to permit rotation of the bushing relative to the screw 158 but prevent axial movement of the bushing along the screw. It should be understood that the positions of the annular recess 180 and snap ring 182 can be reversed with that of the annular shoulder 170 depending upon the radial load direction.

The locking means 174 of the radial adjustment mechanism 154 permits securing the bushing 168 at a selected one of a plurality of angularly displaced positions relative to the shroud mounting section 178. The positions are located along one complete rotational turn of the bushing 168 relative to the mounting section bore 176. Such rotational adjustment of the bushing 168 also produces axial movement thereof relative to the mounting section 178 and concurrently therewith axial movement of screw 158 which results in radial adjustable movement of the shroud segment 156 relative to the rotor without changing the rotational orientation of the screw 158 and thus without disturbing its connection to the lever arm 160.

More particularly, the locking means 174 includes a plurality of circumferentially spaced first holes 184 formed through a rim 168A on the bushing 168 which define the possible angularly displaced positions of the bushing 168. The locking means 174 also includes a plurality of circumferentially spaced second holes 186 formed through a rim 188 about the bore 176 in the mounting section 178. Different pairs of the first and second holes 184, 186 can be aligned with one another at each of the angularly displaced positions for locking the bushing 168. It can be seen in FIG. 12 that the first holes 184 are greater in number than the second holes 186. Finally, the locking means 174 includes a locking pin 190 insertable through the particular pair of aligned first and second holes 184, 186 defining the angular position at which the bushings 168 will be locked.

There is no need for special tooling to adjust the mechanism 154 to initially set the desired rotor shroud clearance. First, before the bushing 168 is installed, the screw 158 is rotated to radially move the shroud segment 156 inwardly into contact with the rotor blade tip. Then the bushing 168 is installed by threading it into the threaded bore 176 and about the screw 158. Next, the snap ring 182 is installed to fix the axial position of the bushing 168 along the screw 158. Now, the bushing 168 is rotated, which concurrently axially moves it and the screw 158 and radially moves the shroud segment 156, until the desired clearance is reached. Lastly, the desired pair of locking holes 184, 186 are aligned and the locking pin 190 inserted through the aligned holes.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. In a gas turbine engine including a rotatable rotor having a row of blades with outer tips and a stationary casing with a shroud and being disposed in concentric relation with said rotor, an apparatus for controlling the clearance between said rotor blade tips and casing shroud, said apparatus comprising:

(a) a shroud segment defining a circumferential portion of said casing shroud, being separate from and disposed in an opening defined in said stationary casing;

(b) a channel defined between radially spaced portions of said stationary casing and said shroud segment;

(c) means disposed in said channel and being preloaded against said spaced portions of said stationary casing and said shroud segment for biasing said shroud segment to move radially inwardly toward said rotor; and (d) a mechanism coupled to said shroud segment and said stationary casing and being operable for radially moving said shroud segment toward and away from said rotor to reach a selected position relative to said rotor at which a desired clearance is established between said shroud segment and said rotor blade tips, said mechanism further being operable for holding said shroud segment at said selected position to maintain said desired clearance between said shroud segment and said rotor blade tips;

(e) said mechanism including at least a pair of threaded drive members rotatably mounted to said stationary casing, said shroud segment including an elongated arcuate body and a pair of threaded connectors spaced from one another and fixedly attached on said arcuate body, said connectors threadably coupled to said drive members such that rotation of said drive members in one direction causes radial movement of said shroud segment toward said rotor, whereas rotation of said drive members in an opposite direction causes radial movement of said shroud segment away from said rotor.

2. The apparatus as recited in claim 1, wherein said biasing means is a wave spring having an undulating configuration along its longitudinal cross section.

3. The apparatus as recited in claim 1, wherein said biasing means is a spring in the form of an elongated strip having an undulating configuration along a longitudinal cross section through said strip and a pair of spaced openings, said spring being mounted on said shroud segment with said connectors of said segment extending through said openings of said spring so as to prevent movement of said spring longitudinally within said channel relative to said shroud segment.

4. The apparatus as recited in claim 1, wherein said biasing means is a spring in the form of an elongated strip having an undulating configuration along a longitudinal cross section through said strip; and said shroud segment includes an elongated arcuate body and at least one element projecting from said body and engaging said spring so as to prevent movement of said spring longitudinally within said channel relative to said shroud segment.

5. The apparatus as recited in claim 1, further comprising:

means for defining inner and outer limits of movement of said shroud segment relative to said stationary casing toward and away from said rotor.

6. The apparatus as recited in claim 5, wherein said limits defining means includes:

a pair of outer and inner radially spaced stop members attached on said stationary casing adjacent each of said opposite edges of said shroud segment; and an intermediate member attached on each of said opposite edges of said shroud segment and projecting therefrom between said outer and inner stop members on said casing for engaging said respective stop members to define inner and outer limits of radial movement of said shroud segment as said shroud segment is moved toward and away from said rotor.

7. The apparatus as recited in claim 6, wherein:

said shroud segment includes an elongated body;

said intermediate member is defined by a hanger flange formed along each of a pair of opposite longitudinal sides of said body; and said pair of stop members is defined by a substantially C-shaped hanger flange formed along each of a pair of opposite sides of said opening in said stationary casing.

8. The apparatus as recited in claim 5, wherein said limits defining means includes:

a pair of outer and inner radially spaced stop members attached on each of said opposite edges of said shroud segment; and an intermediate member attached on said stationary casing adjacent each of said opposite edges of said shroud segment and projecting therefrom between said outer and inner stop members on said shroud segment for engaging said respective stop members to define inner and outer limits of radial movement of said shroud segment as said shroud segment is moved toward and away from said rotor.

9. The apparatus as recited in claim 8, wherein:

said shroud segment includes an elongated body;

said pair of stop members is defined by a substantially C-shaped hanger flange formed along each of a pair of opposite longitudinal sides of said body; and said intermediate member is defined by a hanger flange formed along each of a pair of opposite sides of said opening in said stationary casing.

* * * * *